US007255029B2

(12) United States Patent
Rastegar et al.

(10) Patent No.: US 7,255,029 B2
(45) Date of Patent: Aug. 14, 2007

(54) MANUALLY OPERATED IMPACT TOOL

(75) Inventors: Jahangir S. Rastegar, Stony Brook, NY (US); Thomas Spinelli, East Northport, NY (US)

(73) Assignee: Omnitek Partners L.L.C.

( * ) Notice: Subject to any disclaimer, the term of this patent is extended or adjusted under 35 U.S.C. 154(b) by 0 days.

(21) Appl. No.: 11/333,852

(22) Filed: Jan. 18, 2006

(65) Prior Publication Data

US 2006/0174467 A1 Aug. 10, 2006

Related U.S. Application Data

(60) Provisional application No. 60/644,651, filed on Jan. 18, 2005.

(51) Int. Cl.
*B25B 19/00* (2006.01)
*B25D 15/00* (2006.01)
*B25B 21/00* (2006.01)

(52) U.S. Cl. ..... 81/463; 81/466

(58) Field of Classification Search ..... 81/463, 81/466; 173/93.5
See application file for complete search history.

(56) References Cited

U.S. PATENT DOCUMENTS 2,954,714 A * 10/1960 Swenson ..... 173/93.5
3,108,506 A * 10/1963 Swenson ..... 173/93.5
3,156,309 A 11/1964 Swenson
3,157,074 A * 11/1964 Durkee ..... 173/93
3,184,998 A * 5/1965 Young ..... 173/93.5
4,106,572 A 8/1978 Anderson
4,184,552 A * 1/1980 Anderson ..... 173/93.5
4,243,109 A 1/1981 Anderson
4,293,044 A 10/1981 Anderson
4,382,476 A * 5/1983 Swenson ..... 173/93.5
4,418,768 A * 12/1983 Swenson ..... 173/93.5
4,455,899 A * 6/1984 Savell ..... 81/466
4,474,091 A 10/1984 Russ
4,759,242 A * 7/1988 Andersson ..... 81/466
4,794,830 A 1/1989 Gross et al.
5,095,784 A * 3/1992 Garver ..... 81/466
6,679,143 B2 * 1/2004 Rastegar et al. ..... 81/466
6,997,087 B2 * 2/2006 Rastegar et al. ..... 81/466
2004/0055431 A1 * 3/2004 Rastegar et al. ..... 81/466

* cited by examiner

*Primary Examiner*—David B Thomas

(57) ABSTRACT

A manually operated impact tool having: a handle; an anvil movably connected to the handle, the anvil having an anvil surface, the anvil further having a fastener engagement portion for engaging a fastener to be loosened or tightened, the fastener engagement portion being substantially rigidly attached to the anvil; a hammer movable with respect to the anvil and handle, the hammer having a hammer surface in cooperation with the anvil surface; an energy storage device for storing potential energy upon a relative movement of the handle and hammer; a locking device for preventing relative movement between the hammer and anvil during the relative movement of the handle and hammer; and a locking release device for unlocking the locking device upon an amount of the relative movement of the handle and hammer such that the potential energy stored in the energy storage device is at least partially transferred to the hammer such that the hammer surface contacts and impacts the anvil surface and at least part of such impact is transferred to the fastener through the fastener engagement portion.

8 Claims, 6 Drawing Sheets

MANUALLY OPERATED IMPACT TOOL

CROSS-REFERENCE TO RELATED APPLICATIONS

This application claims the benefit of U.S. Provisional Application Ser. No. 60/644,651, filed Jan. 18, 2005, the entire contents of which is incorporated herein by its reference.

BACKGROUND OF THE INVENTION

1. Field of the Invention

The present invention relates generally to impact tools and, more particularly, to manually operated impact tools such as an impact wrench which tightens or loosens a nut from a mating threaded shaft.

2. Prior Art

Impact based or impact assisted wrenches of the prior art operate using electric, pneumatic and in some cases hydraulic power to loosen and/or tighten fasteners such as nuts threaded on a mating treaded stud. The impact force generated by such wrenches greatly assists the loosening and tightening operation of such devices by generating a large impulsive force at the fastener interface. As the result, and in many cases due also to the generated stress waves that travels across the male and female fastener surfaces, such wrenches are operated with a significantly smaller operator effort. In certain situations, the large forces and/or moment and/or torque that has to be applied to a manually operated wrench to begin to open the fastener may cause its failure, particularly since such forces cannot usually be applied perfectly symmetrically, i.e., only in the direction that would open the fastener without unwanted added forces. For example, an operator applying a torque to a manually operated socket wrench to open a bolt may also apply a large shearing force and/or bending moment while exerting his maximum effort to open the fastener and thereby may cause the bolt to shear off during the procedure. Such failures seldom occur while using impact based wrenches since the operator does not have to exert his or her maximum effort in the above manner to operate the wrench.

It can safely be claimed that the relative ease with which impact based wrenches are operated to loosen or tighten various fasteners is well appreciated by their users. However, such wrenches require electric, pneumatic or some other type of generally electric based power in order to operate. In addition, such systems are generally heavy, bulky and expensive to be carried by the operator to all sites. This is particularly the case for the infrequent user such as a driver who may require the wrench in case of a flat tire to loosen and fasten the tire bolts or nuts.

A need therefore exists in the art for manually operated impact wrenches that are simple to use, light weight and inexpensive, particularly for the casual user and professional user who does not have access to a power source at the work site or who does not want to carry a heavy load to a site or may seldom face the need for its use.

SUMMARY OF THE INVENTION

Accordingly, a manually operated impact tool is provided. The impact tool comprising: a handle; an anvil movably connected to the handle, the anvil having an anvil surface, the anvil further having a fastener engagement portion for engaging a fastener to be loosened or tightened, the fastener engagement portion being substantially rigidly attached to the anvil; a hammer movable with respect to the anvil and handle, the hammer having a hammer surface in cooperation with the anvil surface; an energy storage device for storing potential energy upon a relative movement of the handle and hammer; a locking device for preventing relative movement between the hammer and anvil during the relative movement of the handle and hammer; and a locking release device for unlocking the locking device upon an amount of the relative movement of the handle and hammer such that the potential energy stored in the energy storage device is at least partially transferred to the hammer such that the hammer surface contacts and impacts the anvil surface and at least part of such impact is transferred to the fastener through the fastener engagement portion.

The energy storage device can be a helical spring.

The locking device can comprise: a locking element rotatably disposed on the anvil, the locking element having a seat for engaging the hammer, and a biasing means for biasing the locking element such that the seat is engaged with the hammer.

The locking release device can comprise: the locking element further having an upturned end; and a release element having an engagement section such that the engagement section engages the upturned end to disengage the locking element from engagement with the hammer upon a predetermined rotation of the handle. The engagement surface can be variable along a length of the release element.

The release element can be automatic or manual.

The handle can be moved in a back and forth motion to continuously provide the impact of the hammer and anvil surfaces or the handle can be moved in a continuous one-way motion to continuously provide the impact of the hammer and anvil surfaces.

BRIEF DESCRIPTION OF THE DRAWINGS

These and other features, aspects, and advantages of the apparatus of the present invention will become better understood with regard to the following description, appended claims, and accompanying drawings where:

DETAILED DESCRIPTION OF THE PREFERRED EMBODIMENT

Although the present invention is applicable to numerous types of impact tools, it is particularly useful in the environment of impact wrenches. Therefore, without limiting the applicability of the present invention to impact wrenches, it will be described in such environment.

The methods used in illustrative embodiments of the manual impact tool is based on operating a handle, working against one or a system of elastic elements and/or structure, hereinafter called elastic element. As an operator moves the handle (one or more combination of rotations and translations), the mechanical work done by the operator is mostly (excluding losses such as those due to friction and damping) transformed into mechanical potential energy that is stored in the elastic element. The tool used to loosen or tighten an intended bolt, nut, screw, etc., or transmit the generated impact force or moment or torque or any combination of the three, is fixed to an anvil element, which can be light weight and very rigid. A hammer element, which can be very massive, is attached to the anvil element by a joint, such as a rotary joint with one degree-of-freedom in rotation. The hammer element can be kept apart from the anvil element by a locking mechanism. As the operator moves the handle, at a certain point, the locking mechanism is released, thereby releasing the hammer. The elastic element will then begin to accelerate the hammer mass, i.e., begins to transfers its stored potential energy to the hammer mass as kinetic energy. The hammer mass then impacts the anvil element, thereby generating an impulsive force, which is then transmitted by the relatively rigid anvil element to the tool used to loosen or tighten the intended bolt, nut, screw, etc. To increase the impact force, it is desired to have as much potential energy stored in the elastic system as possible and to provide enough travel space between the hammer and the anvil so that the hammer mass has enough time to be accelerated to as high as a velocity as possible. The hammer mass can be as large as possible and as closely positioned to the point of impact with the anvil as possible.

The design of the illustrative embodiments disclosed below comprise the following six elements:

1. A handle element,
2. A hammer element,
3. An anvil element,
4. A locking element,
5. A lock release element,
6. A mechanical energy storage element, i.e., elastic, element.

The above elements and their associated functions can be provided in separate physical elements or two or more of their functions can be combined and provided by one physical element.

Figure 1:
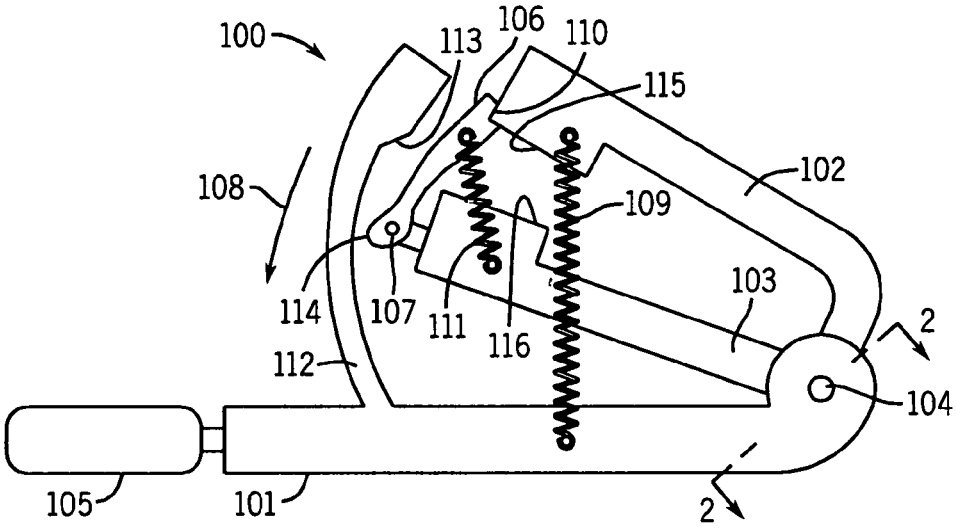
FIG. 1 illustrates a top view of an embodiment of an impact tool configured as an impact wrench.

The above elements, including their individual function, and the operation of the present impact tool are better described by the illustrative embodiment shown in FIG. 1, referred to generally by reference numeral 100. A handle 101 and a hammer 102 are movably joined to the anvil 103 about joint 104. The joint 104 may be rotational as shown for the embodiment of FIG. 1, or prismatic (sliding). The joint 104 may also be rotational and share a common axis with one or more of the handle 101, hammer 102, and/or anvil 103, as shown in FIG. 1. Alternatively, the joint 104 can be separate joints for rotatably connecting the handle 101, hammer 102, and anvil 103. The handle 101 can be equipped with a portion 105 suitable for comfortable operation by the user. A second handle 105*a* (FIG. 2) may be provided on the impact tool 100, such as at the joint 104, for a two-handed operation of the same.

Figure 2:
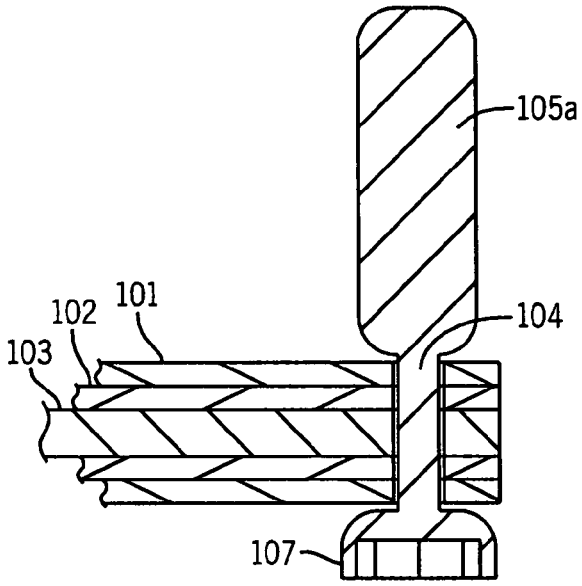
FIG. 2 illustrates a sectional view as taken along line 2-2 in FIG. 1.

A wrench head 107 can be rigidly attached to the anvil 103 as shown in FIG. 2. In FIG. 2, the wrench head 107 is shown to be a socket head, but may be any other type of tools, such as hexagonal Allen wrenches, screw driver heads, and the like. Alternatively, the head 107 may be a standard male or female end, to which other sockets, hexagonal Allen wrenches, screw driver heads, etc., are interchangeably coupled. Where the impact tool 100 is used to rotate a fastener, such as a nut to tighten or loosen the same, the head 107 is preferably rigidly fixed at the joint 104.

A mechanical energy storage elastic element 109 is attached on the one end to the handle 101 and on the other side to the hammer 102. In FIG. 1, the mechanical energy storage elastic element 109 is a helical extension spring 109. However, any other type of elastic elements, for example those working in bending, torsion, compression, or their combination, and in fact any elastic element may be used for this purpose. In addition, more than one spring (elastic) element 109, with linear or nonlinear characteristics may be employed.

A locking element 106 is hinged to the anvil 103, allowing it to rotate relative to the anvil 103. In FIG. 1, a rotary joint 107 is used to attach the locking element 106 to the anvil 103. However, other types of joints (with one or more degrees-of-freedom) may also be employed. The function of the locking element 106 is to lock the hammer 102 a certain distance (in this case, rotational distance) away from the anvil 103 as the elastic element 109 is extended, i.e., as the handle 101 is rotated counterclockwise in the direction 108, when the locking element 106 is engaged (as shown in FIG. 1). The locking element 106 engages the hammer 102 at a seating 110. A biasing spring 111 is used to keep the locking mechanism biased towards engaging the hammer 102 and locking it at a prescribed rotational distance from the anvil 103.

A release element 112 is fixed to the handle 101. The release element 112 has an engagement section 113 (a cam surface in FIG. 1), which as the handle 101 is rotated in the direction 108 relative to the anvil 103, the engagement section 113 engages an end 114 of the locking element 106, and upon further rotation of the handle 101, causes the locking element to rotate counterclockwise, the seating 100 to come out of engagement with the hammer 102, and accelerate the hammer 102 towards the anvil 103.

The operation of the impact tool 100 of the embodiment shown in FIGS. 1 and 2 is as follows. The wrench head 107 is first engaged with the component to be loosened or tightened, the anvil 103 is thereby fixed and cannot freely rotate. The user will then begin to rotate the handle 101 by the end 105. The locking element 106 is engaged with the hammer 102 thereby preventing the hammer 102 from rotating in the same direction 108 as the handle 101 as the spring element 109 is extended. The locking element 106 also keeps the hammer 102 a certain distance (in rotation) from the anvil 103. As the handle 101 continues to rotate in the direction 108, at a certain point the (cam) surface 113 of the release element 112 reaches the surface 114 of the locking element 106, and upon further rotation of the handle 101, releases its engagement at the seating 110 with the hammer 102. The force exerted by the extended spring 109 will then begin to accelerate the hammer 102 in rotation in the direction 108, i.e., the spring element 109 begins to transfer at least part of its stored potential energy to the hammer 102 as kinetic energy. At a certain point, the hammer surface 115 of the hammer 102 impacts the anvil surface 116 of the anvil 103, thereby transmitting an impulsive (impact) torque to the wrench head 107 in the direction 108, and through the wrench head 107 to the component to be loosened or tightened. Following the impact, the handle 101 is rotated clockwise (opposite to the direction 108), until spring element 109 begins to compress and thereby push the hammer 102 away from the anvil 103. Eventually, the handle 101 reaches the anvil 103, and in the meanwhile, the hammer 102 passes the seating 110 of the locking element 106, which locks the hammer 102 away from the anvil 103 as the operator resumes to turn the handle 102 in the counterclockwise (108) direction. The process is continued until the intended loosening or tightening operation is complete. After the fastener is loosened, the impact tool 100, another tool or the operator's fingers can be used to completely remove the same.

Figure 3:
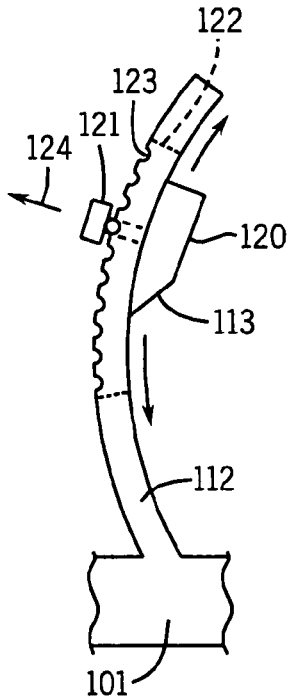
FIG. 3 illustrates an alternative release element for the impact tool of FIG. 1.

In one variation of the above design, the cam surface 113, which can be an integral part of the release element 112 and the handle 101, is made to be adjustable. This can be readily accomplished by providing a separate cam element 120, as shown in FIG. 3, with the cam 113, and making it adjustable along a circular arc defined by the release element 112. The cam element 120 is held fixed to the release element 112, i.e., to the handle 102, during the operation of the impact tool. The position of the cam element 120 relative to the release element 112 may be continuously variable or may be adjustable to two or more positions as shown in the embodiment of FIG. 3. In this embodiment, the release element 112 is provided with a slot 122, through which a spring loaded locking pin 121 passes. Grooves 123 are provided on the release element 112. To adjust the position of the cam 113 and cam element 120 along the arc of the release element 112, the pin 121 is pulled away in the direction 124, thereby releasing the pin 121 from the groove 123. The cam element 120 is then positioned at the desired groove 123, and the pin 121 is released to lock in the desired groove 123, thereby holding the cam element 120, i.e., the cam 113, fixed relative to the release element 112. By fixing the cam element 120 closer to the handle 101, the locking element 101 releases the hammer 102 following a smaller counterclockwise rotation of the handle 101, reducing the impact and requiring a smaller operating force. Conversely, by fixing the cam element 120 further away from the handle 101, the locking element 101 releases the hammer 102 following a larger counterclockwise rotation of the handle 101, increasing the impact and requiring a larger operating force.

Figure 4:
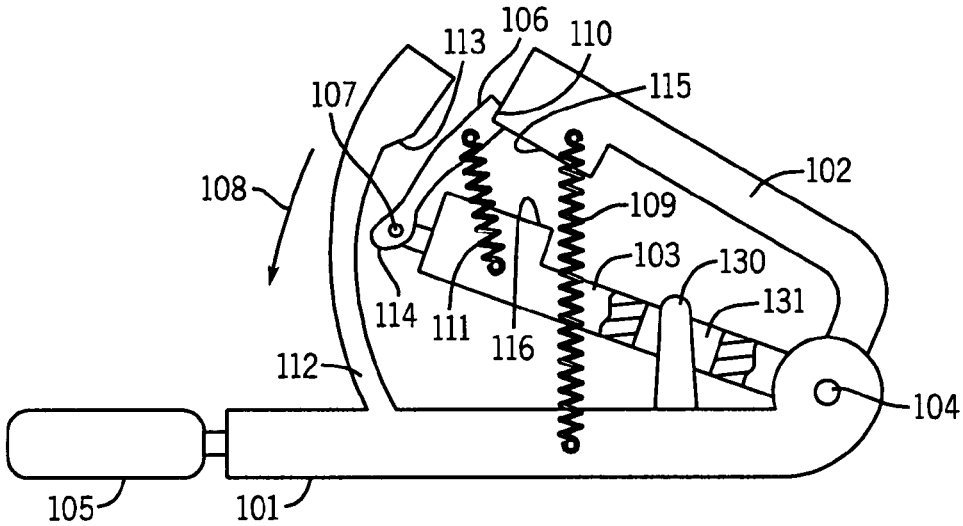
FIG. 4 illustrates a top view of an embodiment of an impact tool configured as an impact wrench and having a lifting element.

In the embodiment of FIG. 1, the spring 109 is used to return the anvil 103 to its locked position during clockwise rotation of the handle 101 following an impact. In another embodiment, shown in FIG. 4, a lifting element 130 is provided on the handle 101. The lifting element 130 is fixed to the handle 101 and passes through a slot 131 provided in the anvil 103 (or passes on one or both sides of the anvil 103). During the clockwise rotation of the handle 101 following an impact, the lifting element 130 pushes the hammer 102 up, past the locking element 106, before the counterclockwise rotation of the handle 101 is resumed for the next impact.

Figure 5:
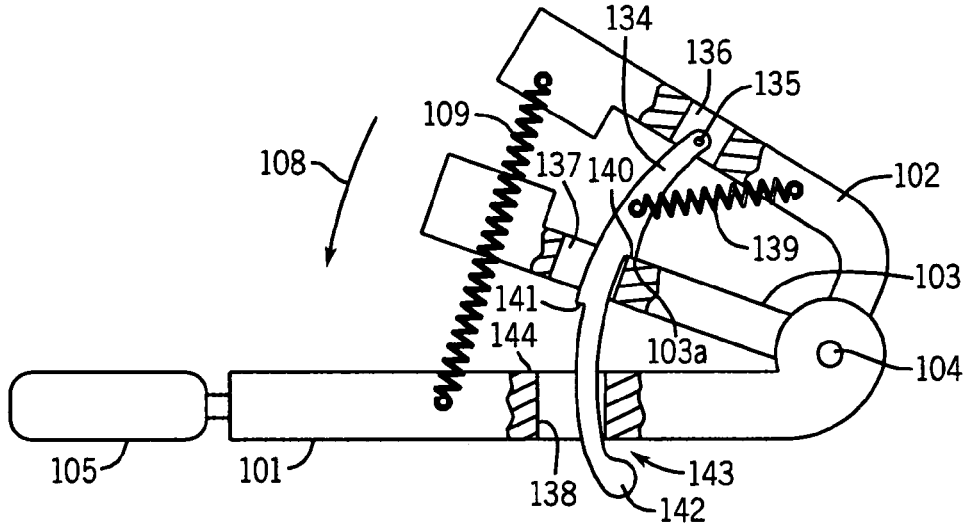
FIG. 5 illustrates a top view of an embodiment of an impact tool configured as an impact wrench and having a combined locking and lifting element.

In another embodiment, a single lever 134 as shown in FIG. 5 performs the functions of the locking element 106 and the lifting element 130. The lever 134 is attached to the hammer 102 by a hinge 135. The attachment point of the hinge 135 may be inside a slot 136 to centrally locate the lever 134 with respect to the anvil 103 and the handle 101. The lever 134 passes through slots (or side depressions) 137 and 138 in the anvil 103 and handle 101, respectively. A spring 139 provides a bias force, which tends to pull the lever 134 towards the common joints 104. During the operation of the manual impact tool of FIG. 5, as the handle 101 is rotated in the direction 108, a step 140 in the lever 134 sits against a surface 103*a* of the anvil 103, thereby keeping the hammer 102 a certain distance apart from the anvil 103. As the handle 101 is further rotated, an extending tip 142 of the lever 134 reaches the bottom portion 143 of the slot 138 of the handle 101, and upon further rotation of the handle 101, the bottom portion 143 pushes the lever 134 clockwise. As a result, the step 140 is also pushed out of engagement with the surface 103*a*, thereby releasing the hammer 102, and allowing it to impact the anvil 103. Following impact, the handle 101 is rotated in the clockwise direction. At a certain point, an upper surface 144 of the slot 138 of the handle 101 reaches another step 141, and begins to push it upwards, thereby beginning to move the hammer 102 away from the anvil 103. By the time that the handle 101 has reached the anvil 103, the step 140 has passed the surface 103*a* of the anvil 103 and engages with the same due to the biasing of the spring 139. As a result, as the handle 101 is again rotated counterclockwise in the direction 108, the step 140 engages the surface 103*a* of the anvil 103, keeping the hammer 102 a certain distance from the anvil 103 as previously described. The impact cycle can then be repeated as described above. Those skilled in the art will appreciate that the magnitude of impact can be varied similar to that described in FIG. 3 by varying the placement of one or both of the steps 140, 141.

Figure 6:
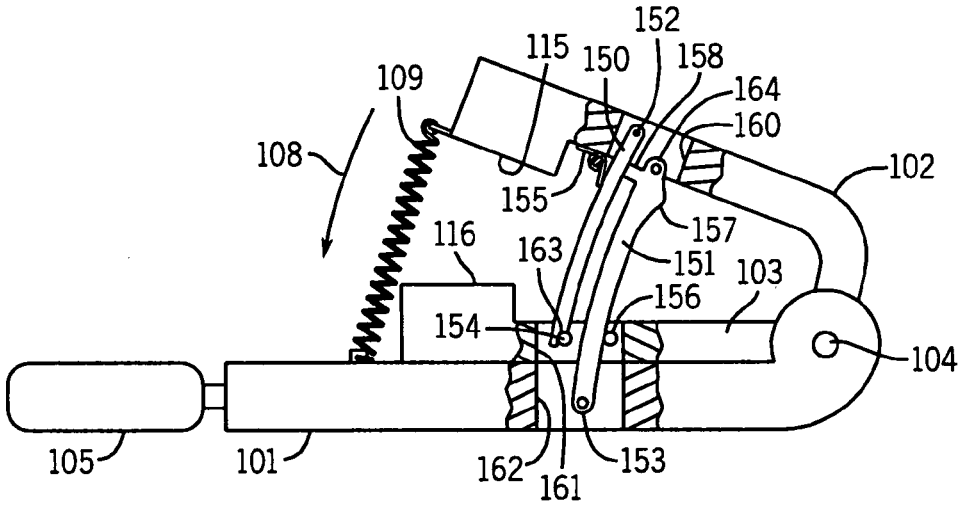
FIG. 6 illustrates a top view of an embodiment of an impact tool configured as an impact wrench and having first and second levers for performing the functions of a combined locking and lifting element.

In another embodiment, the lever 134 is replaced with first and second levers 150 and 151, respectively, as shown in FIG. 6. The first lever 150 is attached to the hammer 102 by a hinge 152. The second lever 151 is attached to the handle 101 by a hinge 153. The first lever 150 is biased to rotate towards the hinge 104 by a spring 155. In the configuration shown in FIG. 6, a step 163 on a free end of the first lever 150 rests against a first pin 154, which is fixed to the anvil 103, thereby keeping the hammer 102 a certain distant apart from the anvil 103. As the handle 101 is rotated counterclockwise in the direction 108, the handle 101 is separated from the anvil 103, thereby pulling the lever 151 down. At a certain point, a cam 157 on the second lever 151 reaches a second pin 156, which is fixed to the anvil 103, and upon further rotation of the handle, a protrusion 158 on the second lever 151 pushes the first lever 150 forward, causing the step 163 to disengage with the first pin 154. As a result, the hammer 102 is released and impacts the anvil 103. As the handle 101 is rotated in the clockwise direction, at a certain point, a top 164 of the second lever 151 reaches a bottom surface of the hammer 102 and begins to push it up until the step 163 passes the first pin 154. Then as the handle 101 is turned counterclockwise again for another impact, at a certain point the step 163 engages the first pin 163 again and keeps the hammer 102 at a distance from the anvil 103. The next impact can then be initiated as described above.

In the embodiments shown in FIGS. 1 and 4-6, the hammer, anvil, the locking element, energy storage spring(s) and other elements are exposed. One main advantage of the present embodiments is that all the above elements can be readily packaged within a chamber produced by the handle 101 (and the extension 112 when present) as shown in FIG.

Figure 7:
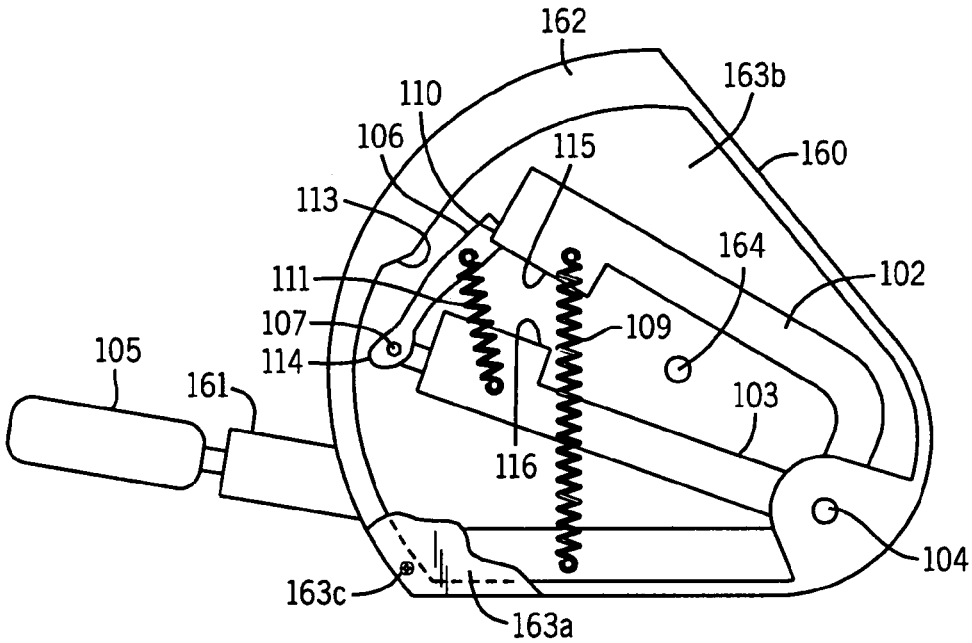
FIG. 7 illustrates a top view of an embodiment of an impact tool configured as an impact wrench and having a chamber for housing elements of the impact tool.

7. In FIG. 7, the closed "wall" 160 is shown formed as an extension to the handle 101. The handle itself 161 may be attached at any convenient location to the wall 160. In FIG. 7, the releasing cam 113 is shown to be integral to the wall 160, but may be made adjustable in a manner similar to that shown in FIG. 3. Once the aforementioned elements are packaged inside the closed wall 160, top and bottom covers 163*a*, 163*b* (only the bottom cover 163*b* is fully shown in FIG. 7, the top cover 163*a* is shown partially to show the internal components of the impact tool) can be attached to the top and bottom surfaces of the wall 160, thereby completely enclosing all the internal moving components of the impact tool. The top and bottom covers 163*a*, 163*b* can be fastened to the wall 160 by any means, such as screws 163*c* or the like. The top and bottom covers 163*a*, 163*b*, can be plastic or other light material to reduce the overall weight of the impact tool. In FIG. 7, the top surface of the wall 160 can be seen and is indicated with the numeral 162. In addition, the lifting element 130 may also be incorporated as a pin 164 fastened to one or both of the top and bottom covers 163*a*, 163*b*, preferably both, to reduce the bending load on the pin 164. To allow the protruding wrench head 107 to rotate about the axis of the joint 104, an appropriate opening or cut-out has to be provided in the bottom cover 163*b*.

Once a bolt or nut is loosened enough so that no more impact loading is required, the handle may be rotated continuously to further loosen and if desired to remove the bolt or nut. In this operation, the force is transmitted from the handle to the hammer 102, and through the hammer 102 to the anvil 103, thereby exerting a loosening torque on the bolt or nut (at this time, the hammer 102 and anvil 103 are in contact at the surfaces 115 and 116). Alternatively, the handle 101 can be provided with a stop (not shown) at the joint 104, which comes into contact with a corresponding stop surface on the anvil 103 at the joint 104. The contact is designed to occur after the handle 101 has been turned enough to release the locking element 106. In a similar configuration, the impact tool 100 can be used to tighten a bolt, nut, etc., by rotating the handle in the clockwise direction opposite to the direction 108. As the handle is rotated in the clockwise direction, the handle 101 comes into contact with the bottom surface of the anvil 103, thereby allowing the operator to apply a tightening torque directly to the bolt, nut, etc., to be tightened.

Figure 8:
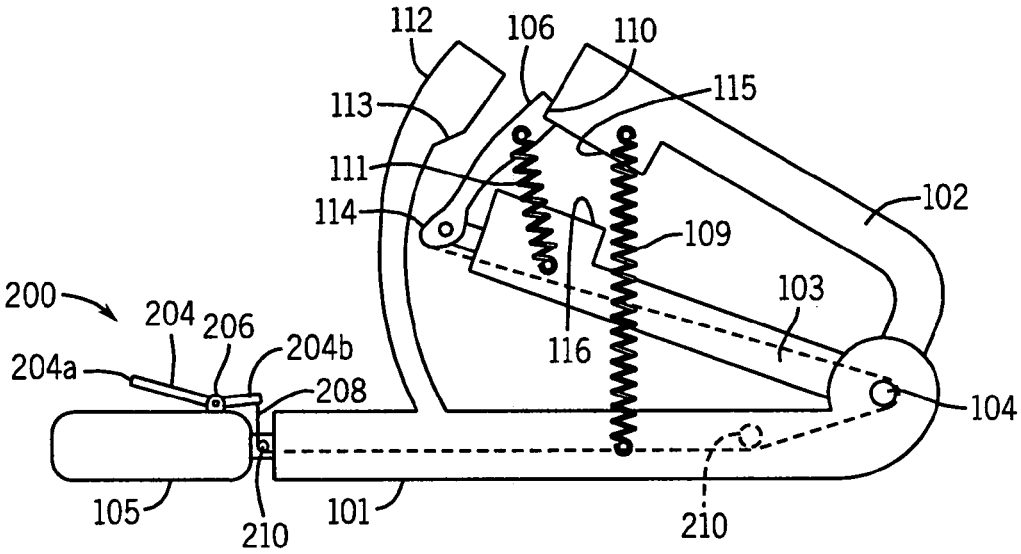
FIG. 8 illustrates a top view of an embodiment of an impact tool configured as an impact wrench and having a manual locking release device.

Referring now to FIG. 8, there is illustrated another embodiment of an impact tool, the impact tool being generally referred to by reference numeral 200. Impact tool 200 is configured as an impact wrench and has similar features as impact tool 100 shown in FIG. 1, with like features being designated with like reference numerals. In addition to, or instead of the release element 112 shown in FIG. 1, impact tool 200 can have a manual release means 202. The manual release means 202 has a lever 204 rotatably connected to the handle 101 by a joint 206. The lever 204 has a longer end 204*a* that is operated by the user to release the locking element 106. The lever 204 also has a shorter end 204*b*. A cable 208 (shown in broken line) is disposed at the short end 204*b* at one end thereof and is disposed at the end 114 of the locking element 106 at another end thereof. The cable can be run through a hole or groove in the handle 101 and anvil 103 or guided along surfaces thereof by appropriate guides (not shown). Pulleys or pins 210 may also be used to change the direction of the cable 208. Upon depressing the long end 204*a* of the lever 204, the cable 208 pulls on the end 114 of the locking element 106 and releases engagement thereof with the hammer 102, thus releasing any stored energy in the helical extension spring 109 to accelerate the hammer surface 115 towards the anvil surface 116. The manual release means 202 can be used as the sole means for releasing the locking element 106 or it can be provided in combination with an automatic means, such as that described with regard to FIG. 1. When provided in combination, the manual release means 202 can be used to "override" the automatic release means to provide an earlier impact.

Figure 9:
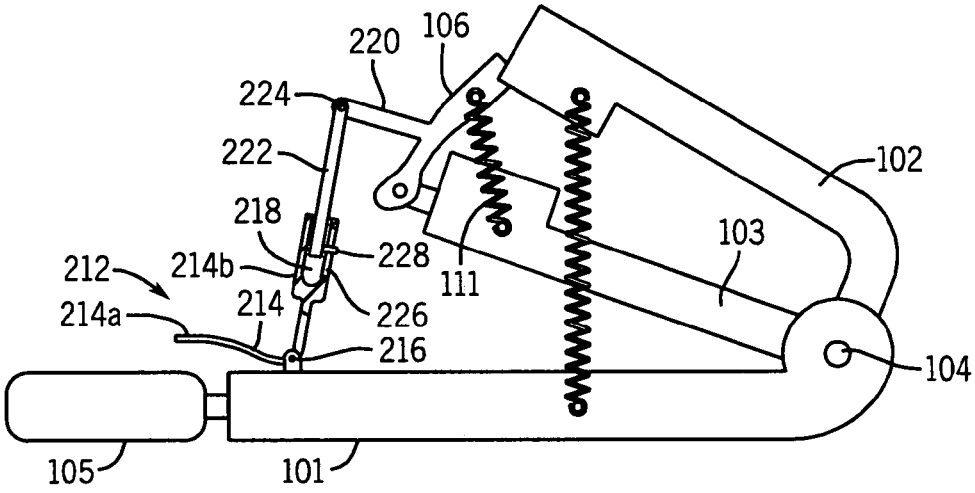
FIG. 9 illustrates a partial top view of an embodiment of an impact tool configured as an impact wrench having an alternative manual locking release device.

Referring now to FIG. 9, there is illustrated a variation of a manual release means 212. The manual release means 212 has a lever 214 rotatably connected to the handle 101 by a joint 216. The lever 214 has a first end 214*a* that is operated by the user to release the locking element 106 and a second end 214*b* having a bore 218. The locking element 106 has a projection 220 upon which a shaft 222 is rotatably disposed at a joint 224. The shaft 222 is slidably disposed in the bore 218 of the second end 214*b*. The second end 214*b* further has a slot 226 in which a pin 228 is slidably disposed. The pin 228 is fixed to the shaft 222 to limit the travel of the shaft 222 relative to the second end 214*b*. As the handle 101 is rotated, the shaft 222 slides within the bore 218 and the locking element 106 is not released until the pin 228 reaches the end of the slot 226 or the first end 214*a* of the lever 214 is depressed. Upon either occurrence, the locking element 106 is released from engagement with the hammer 102, thus releasing any stored energy in the helical extension spring 109 to accelerate the hammer surface 115 towards the anvil surface 116.

Figure 10:
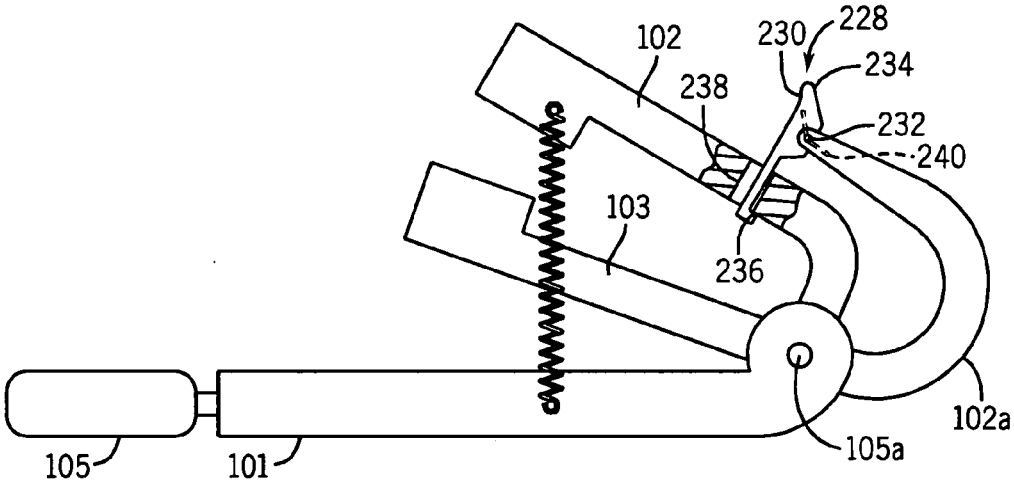
FIG. 10 illustrates a top view of an embodiment of an impact tool configured as an impact wrench and having yet another alternative manual locking release device.

Referring now to FIG. 10, there is shown yet another variation of a manual release means 228. The manual release means 228 has an extension 102*a* of the anvil 102 that extends on an opposite side of the joint 104. A release element 230, similar to the release element 106 of FIG. 1 is rotatably disposed on an end of the extension 102*a* about a joint 232. The release element 230 has an end 234 for operation by a finger of the user's hand and a seating 236. The hammer 102 has an opening 238 through which the release element 230 passes. The seating 236 engages an edge of the opening 238 to maintain a distance between the hammer 102 and anvil 103. The release element 230 can be biased into engagement with the hammer 102, such as by a helical spring (not shown) disposed between the release element 230 and the extension 102*a* or a torsional spring 240 located at the joint 232. While grasping a second handle 105*a*, the user can manipulate the end 234 to release the release element 230 from engagement with the hammer 102, thus releasing any stored energy in the helical extension spring 109 to accelerate the hammer surface 115 towards the anvil surface 116.

Figure 11:
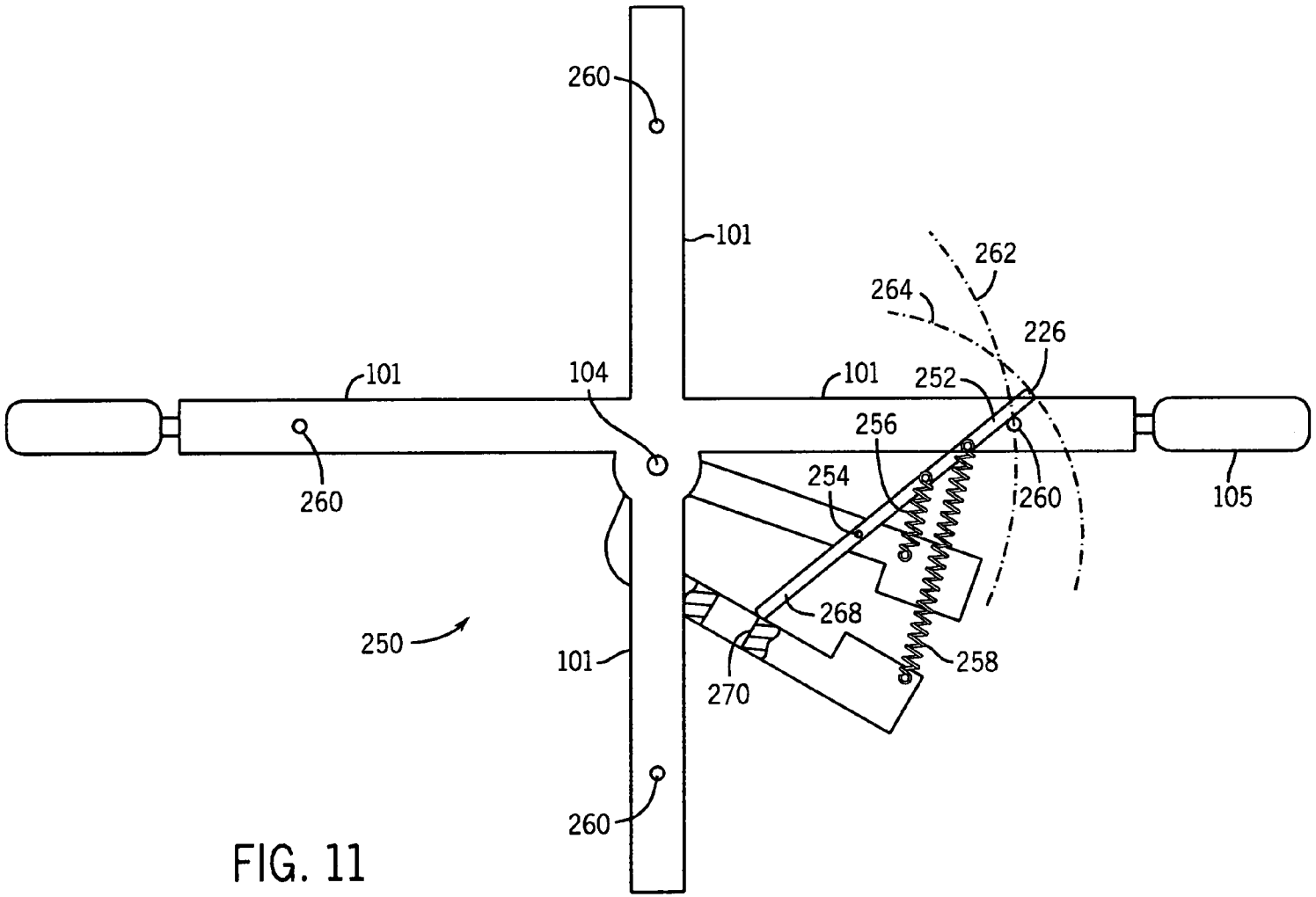
FIG. 11 illustrates a top view of an embodiment of an impact tool configured as an impact wrench and having a continuous rotation input.

In all the above embodiments, rotating the handle back and forth through a certain range of motion operates the manual impact wrench. In certain applications, it may be desirable to have the handle turned continuously, and produce one or more impacts during each full rotation of the handle (or a single impact for more than a full rotation). Referring to FIG. 11, there is illustrated an embodiment of an impact tool, generally referred to by reference numeral 250, having such a continuous motion. In the description of the impact tool 250, like features to the other embodiments described above are identified with like reference numerals. The impact tool 250 has an intermediate member 252 rotatably disposed on the anvil 103 about a joint 254. The intermediate member is biased to both the hammer 102 and anvil 103 by biasing springs 256, 258, respectively. The handle 101 has a pin 260 or other projection that engages a surface of the intermediate member 252. A plurality of handles 101 can be provided, at least two of which can have a portion 105 suitable for comfortable operation by the user such that a two handed operation of the impact tool 250 can be carried out (one of the handles having portion 105 is shown with a cut-out so as to fit on the page, however, it is assumed that such handle has similar dimensions to the other handle 101 having the portion 105). Each of the handles 101 has the pin 260 located at a predetermined distance from the joint 104. Although not shown, the distance between the pin 260 and joint 104 can be variable to change the amount of impact produced by the impact tool 250. Similarly, the length of the intermediate member (or at least the portion that engages with the pin 260) can also be variable to change the amount of impact produced by the impact tool 250. As the handle 101 is rotated, the intermediate member 252 pulls the anvil 103 apart from the hammer 102 to store energy in the springs 258, 256. When the path 262 of the pin intersects with the path 264 of an end 266 of the intermediate member 252, the intermediate member 252 no longer engages the pin 260. At the same time, another end 268 of the intermediate member 252 will rotate into an opening 270 in the hammer 102 and permit relative movement between the hammer 102 and anvil 103, thus providing an impact. The edges of the opening and/or end 268 can be rounded to facilitate the operation thereof. Continued rotation of the handle 101 (in the counterclockwise direction) will reset the intermediate member 252 as shown in FIG. 11 on the same handle (if only one handle/pin are provided) or on a next (in the clockwise direction) of two or more such handle/pins if two or more are provided. Therefore, a continuous input motion can provide a plurality of impacts for each complete circle of input. As an alternative to the other end 268 for releasing the hammer 102 relative to the anvil 103, a locking element 106 can be provided as shown in FIG. 1, and a release element 112 can be provided for each handle 101 (which can be a continuous circle having an engagement section 113 corresponding to each handle).

While there has been shown and described what is considered to be preferred embodiments of the invention, it will, of course, be understood that various modifications and changes in form or detail could readily be made without departing from the spirit of the invention. It is therefore intended that the invention be not limited to the exact forms described and illustrated, but should be constructed to cover all modifications that may fall within the scope of the appended claims.

What is claimed is:

1. A manually operated impact tool comprising:

a handle;

an anvil movably connected to the handle, the anvil having an anvil surface, the anvil further having a fastener engagement portion for engaging a fastener to be loosened or tightened, the fastener engagement portion being substantially rigidly attached to the anvil;

a hammer movable with respect to the anvil and handle, the hammer having a hammer surface in cooperation with the anvil surface;

an energy storage device for storing potential energy upon a relative movement of the handle and hammer;

a locking device for preventing relative movement between the hammer and anvil during the relative movement of the handle and hammer; and a locking release device for unlocking the locking device upon an amount of the relative movement of the handle and hammer such that the potential energy stored in the energy storage device is at least partially transferred to the hammer such that the hammer surface contacts and impacts the anvil surface and at least part of such impact is transferred to the fastener through the fastener engagement portion;

wherein the locking device comprises a locking element rotatably disposed on the anvil, the locking element having a seat for engaging the hammer and a biasing means for biasing the locking element such that the seat is engaged with the hammer.

2. The manually operated impact tool of claim 1, wherein the energy storage device is a helical spring.

3. The manually operated impact tool of claim 1, wherein the locking release device comprises:

the locking element further having an upturned end; and a release element having an engagement section such that the engagement section engages the upturned end to disengage the locking element from engagement with the hammer upon a predetermined rotation of the handle.

4. The manually operated impact tool of claim 3, wherein the engagement surface is variable along a length of the release element.

5. The manually operated impact tool of claim 1, wherein the release device is manual.

6. The manually operated impact tool of claim 1, wherein the handle is moved in a back and forth motion to continuously provide the impact of the hammer and anvil surfaces.

7. The manually operated impact tool of claim 1, wherein the handle is moved in a continuous one-way motion to continuously provide the impact of the hammer and anvil surfaces.

8. A manually operated impact tool comprising:

a handle;

an anvil movably connected to the handle, the anvil having an anvil surface, the anvil further having a fastener engagement portion for engaging a fastener to be loosened or tightened, the fastener engagement portion being substantially rigidly attached to the anvil;

a hammer movable with respect to the anvil and handle, the hammer having a hammer surface in cooperation with the anvil surface;

an energy storage device for storing potential energy upon a relative movement of the handle and hammer;

a locking device for preventing relative movement between the hammer and anvil during the relative movement of the handle and hammer; and a locking release device for unlocking the locking device upon an amount of the relative movement of the handle and hammer such that the potential energy stored in the energy storage device is at least partially transferred to the hammer such that the hammer surface contacts and impacts the anvil surface and at least part of such impact is transferred to the fastener through the fastener engagement portion;

wherein the release device is automatic.

* * * * *